United States Patent [19]

Takehana

[11] Patent Number: 4,756,341

[45] Date of Patent: Jul. 12, 1988

[54] METHOD OF AND APPARATUS FOR AUTOMATICALLY RESETTING WEFT STORAGE DEVICE

[75] Inventor: Tatsuo Takehana, Matsutou, Japan

[73] Assignee: Tsudakoma Corp., Kanazawa, Japan

[21] Appl. No.: 903,816

[22] Filed: Sep. 4, 1986

[30] Foreign Application Priority Data

| | | | |
|---|---|---|---|
| Sep. 4, 1985 | [JP] | Japan | 60-196821 |
| Sep. 4, 1985 | [JP] | Japan | 60-196822 |
| Sep. 11, 1985 | [JP] | Japan | 60-138088[U] |
| Sep. 11, 1985 | [JP] | Japan | 60-199540 |

[51] Int. Cl.[4] ..... D03D 47/30

[52] U.S. Cl. ..... 139/435; 139/450; 139/452

[58] Field of Search ..... 139/1 R, 11, 116, 450, 139/452, 429, 435, 336.4

[56] References Cited

U.S. PATENT DOCUMENTS 4,559,976 12/1985 Araki et al. ..... 139/435

4,658,866 4/1987 Takegawa ..... 139/450

*Primary Examiner*—Henry S. Jaudon

*Attorney, Agent, or Firm*—Flynn, Thiel, Boutell & Tanis

[57] ABSTRACT

A weft storage device has a drum around which a weft yarn is wound by a rotatable yarn guide, weft yarn withdrawal from the drum being controlled by a movable engaging pin. When the weft yarn breaks, any yarn remaining on the drum is cut off and the scraps are withdrawn by a suction arrangement. The yarn guide is moved to an angular position near the suction arrangement so an end of the yarn is held by the suction arrangement, and then to another angular position. A guide part then engages the yarn between the suction arrangement and yarn guide and moves it to the inlet of an injection nozzle, the air flow in the nozzle then threading the yarn into the nozzle. The engaging pin is then actuated to hold the yarn on the storage drum, and the yarn guide then winds a predetermined number of turns of the yarn onto the drum.

20 Claims, 8 Drawing Sheets

METHOD OF AND APPARATUS FOR AUTOMATICALLY RESETTING WEFT STORAGE DEVICE

BACKGROUND OF THE INVENTION

1. Field of the Invention

The present invention relates to a weft storage device for a fluid jet loom, and more particularly to a method of and an apparatus for automatically resetting a weft storage device to a restarting state when the weft yarn is broken between the supplier and the main nozzle by drawing an end of a new weft yarn from a yarn supplier, guiding the weft yarn automatically to a main nozzle preparatorily winding the weft yarn around a storage drum, and further threading the weft yarn to the main nozzle.

2. Description of the Prior Art

When the weft yarn is broken between a supplier and a main nozzle during a weaving process a feeler detects a breakage state of the weft yarn to stop a loom automatically. Thereafter, an engaging pin is retracted by pushing a manual button so that the weft yarn on the storage drum can be manually drawn out by an appropriate amount, and a preparation winding button is pushed down to thereby allow the weft yarn to be preparatorily wound around an outer circumference surface of the storage drum as a required number of turns by a rotatable yarn guide, and further the end of weft yarn is threaded manually to the main nozzle.

In a drum-type weft storage device, a weft yarn is metered while it is engaged with an engaging pin, and wound around an outer circumference surface of the stationary storage drum by a rotation of a rotatable yarn guide, and stored on the storage drum. The weft yarn is released by retracting the engaging pin so that the weft yarn is ready to be threaded.

During a series of operations mentioned above, the loom and the weft storage device are automatically respectively stopped when the weft yarn is broken between the storage drum and the main nozzle. When the loom is stopped, the engaging pin is forcibly retracted by operating the manual button, and the weft yarn stored around the storage drum is manually drawn out by the appropriate length, and the preparation winding button is pushed down so that the weft yarn is wound around the outer circumference surface of the storage drum a required number of turns by the rotation of the rotatable yarn guide.

Such manual operation of resetting the weft yarn is troublesome and takes much time for preparation in order to reset an operation necessary for a preparatory winding and a yarn threading when the weft yarn is broken between the supplier and the main nozzle, so that an automatic resetting operation is desired.

SUMMARY OF THE INVENTION

It is therefore an object of the present invention to provide a method of and apparatus for automatically resetting a weft storage device by threading a weft yarn into a main nozzle and by preparatorily winding the weft yarn around a storage drum so that an operation of resetting is reduced and a time for resetting is shortened to increase the availability of the loom.

To achieve the above object the present invention is structured in that a rotatable yarn guide is stopped at first at a prescribed angle, namely at a first stoppage position when the weft yarn is broken between a supplier and a main nozzle for weft yarn insertion, an end of the weft yarn from the rotatable yarn guide is temporarily held by a yarn supporter, for example a suction pipe provided outside, the guide thereafter the rotatable yarn guide is rotated through a prescribed angle, namely to a second position for thereby allowing the weft yarn to be interposed into a moving path of a yarn guide member located between the rotatable yarn guide and the yarn supporter, and thereafter the weft yarn is held by the tip end of the yarn supporter so that the weft yarn is guided into the inlet end of the main nozzle.

The rotatable yarn guide causes the weft yarn to be wound around an outer circumference surface while the weft yarn is held by an engaging pin, and the rotatable yarn guide is automatically stopped when the weft yarn is wound a prescribed number of turns. When the winding operation is completed, the weft guide member allows an end of the weft yarn to be released from the yarn supporter, and the engaging pin allows the weft yarn wound around the drum to be released so that the weft yarn is in a free state and is ready to be threaded with an air stream into the main nozzle for weft insertion. Thus, the operations for preparatorily winding a weft yarn are automatically effected. Such a series of operations are effected by a rotation controller and a preparation winding controller under a simple sequence control, while each operation step is respectively confirmed.

Accordingly, the end of weft yarn is held by the weft supporter at the side of the rotatable yarn guide, and the end of the weft yarn is moved to a position crossing the path of movement of the yarn guide member by rotation of the rotatable yarn guide so that the end of the weft yarn is securely held by the yarn guide member when the yarn guide member advances. The end of the weft yarn is securely guided to the inlet end of the main nozzle with the advance of the yarn guide member, and the weft yarn is wound around the storage drum in a prescribed length after the weft yarn is guided to the main nozzle, and thereafter the weft yarn wound around the storage drum is released for the prescribed number of turns for thereby allowing the end of the weft yarn to be drawn into the main nozzle. As a result, a weft threading is securely effected from the side of the weft storage device to the main nozzle, and the preparation winding operation on the weft storage device is automatically carried out so that the loom is automatically restarted.

It is another object of the present invention to automatically remove the weft yarn remaining on the storage drum when the weft yarn is broken between the storage drum and the main nozzle so that the time needed for a preparation winding operation of a new weft yarn is reduced to thereby increase an availability of the loom.

To achieve the above object, a suction pipe and weft yarn cutter are retractably provided with respect to the storage drum so that an open end of the suction pipe is moved close to the weft yarn wound around the storage drum when the weft yarn is broken during the weaving process, the weft yarn on the storage drum is cut off at a position close to the open end of the suction pipe for causing the weft yarn on the storage drum to be automatically drawn into an interior of the suction pipe, and the end of the weft yarn communicating with the rotatable yarn guide is held by the suction pipe. By this operation the new weft yarn in the required number of turns is automatically preparatorily wound around the outer circumference surface of the stationary storage drum. Such a series of operation is effected by a simple sequence control.

Accordingly, the operation of preparation winding of the rotatable yarn guide is automatically carried out since the weft yarn which remained on the storage drum is cut off by a cutter when the weft yarn is broken. Thereafter the cut-off the weft yarn is discharged by the suction pipe, and the end of weft yarn from the rotatable yarn guide is held by the suction pipe for thereby allowing the preparation winding operation to be effected automatically. Therefore, the preparation winding operation by operators is reduced and the preparation winding operation is effected within a short period of time to thereby increase the availability of the loom.

It is a still further object of the present invention to provide a double speed mechanism for effectively driving the yarn guide member so that a stroke of a driving source is halved and simultaneously a speed for the driving source is doubled.

DESCRIPTION OF PREFERRED EMBODIMENTS

Figure 1:
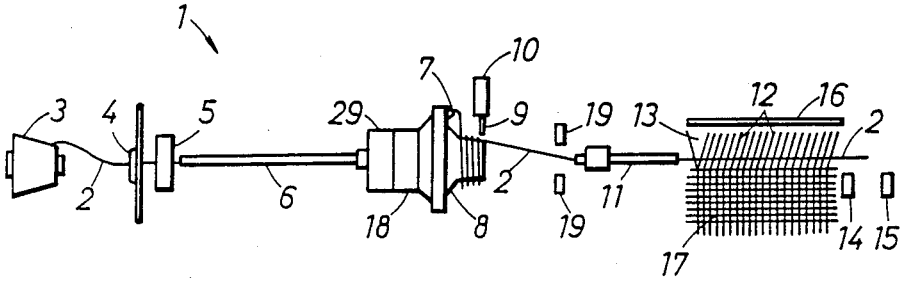
FIG. 1 is a schematic plan view of a weft storage device according to the present invention.

First Embodiment (FIGS. 1 to 5):

FIG. 1 shows a structure of a weft storage device. A weft yarn 2 is supplied by a supplier 3 and introduced into a rotatable yarn guide 7 through a yarn guide 4 and through a guide pipe 6 via a feeler 5. The weft yarn thus introduced into the rotatable yarn guide 7 is metered by a rotatable movement of the rotatable yarn guide 7, while it is being held by an engaging pin 9, around an outer circumference surface of a stationary drum 8 so that the weft yarn is stored on the storage drum 8. The engaging pin 9 is movable toward and away from the outer circumference surface of the storage drum 8, and the engaging pin 9 is retracted from the surface when released by, for example, an electromagnetic solenoid 10.

Figure 2:
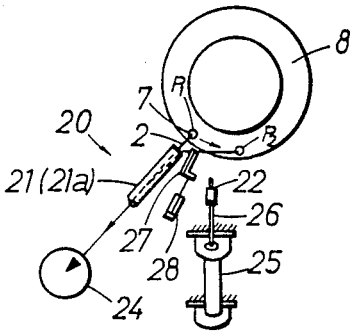
FIG. 2 is a front elevational view of a main part of an automatic resetting apparatus of the present invention.
Figure 3:
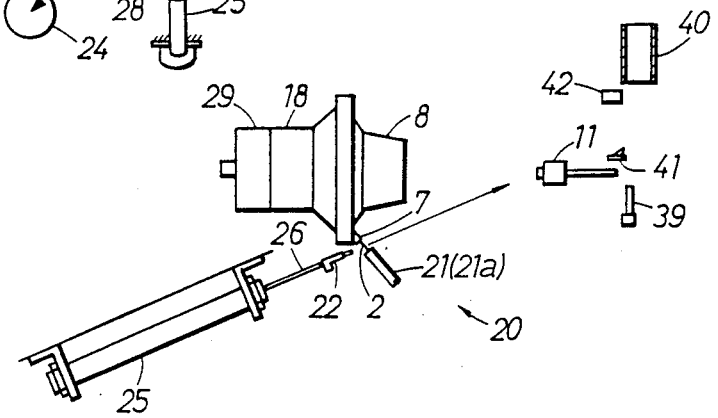
FIG. 3 is a plan view of the apparatus of FIG. 2.

The weft yarn 2 when released is inserted into an opening or shed 13 of warp yarns 12 by a main nozzle 11 for weft insertion. Such weft insertion is detected by, for example, two photoelectric feelers 14, 15 provided at the side of the shed 13 to which the leading end of the inserted weft yarn travels. Thereafter, the weft yarn 2 in the weft yarn threading state is beaten by a beating operation to produce a woven fabric 17. The rotatable yarn guide 7 is drivable by a feeder motor 18 provided at the central line of the storage drum 8. At the inlet end of the main nozzle 11 is a feeler 19 which detects a breakage of the weft yarn 2 between the storage drum 8 and the main nozzle 11. The automatic resetting apparatus according to the present invention, including a yarn supporter 21, a yarn guide member 22, a rotation controller 23, a preparation winding controller 43, and a yarn threading controller 46 is shown in relation to a weft storage device in FIGS. 2 to 4. First, FIGS. 2 and 3 show the arrangement of the yarn holder 21 and the yarn guide member 22 in relation to the storage drum 8. The yarn holder 21 is composed of a suction pipe 21a connected with a suction air generator source 24, and provided at a position outside of the rotation track of the rotatable yarn guide 7 and directed inwardly. The yarn guide member 22 is fixed at a tip end of a piston rod 26 of an air cylinder 25 for movement from a position adjacent an outer peripheral portion of the rotatable yarn guide 7 to a position adjacent the main nozzle 11, and is composed of an electromagnetic type or air pressure driving type clamper for clamping the weft yarn 2. The air cylinder 25 is fixedly mounted at an appropriate position on a frame, etc. A cutter 27 and an operation unit 28 for actuating cutter 27 are respectively provided close to the yarn holder 21.

A blowing nozzle 39 is provided at a position close to the main nozzle 11 so as to discharge air transversely across the outlet of main nozzle 11. A suction pipe 40 is provided in confronting relation with the blowing nozzle 39. A cutter 41 is provided between the main nozzle 11 and the suction pipe 40 and at a position close to the main nozzle 11. A feeler 42 is provided at the side of an open end of the suction pipe 40.

Figure 4:
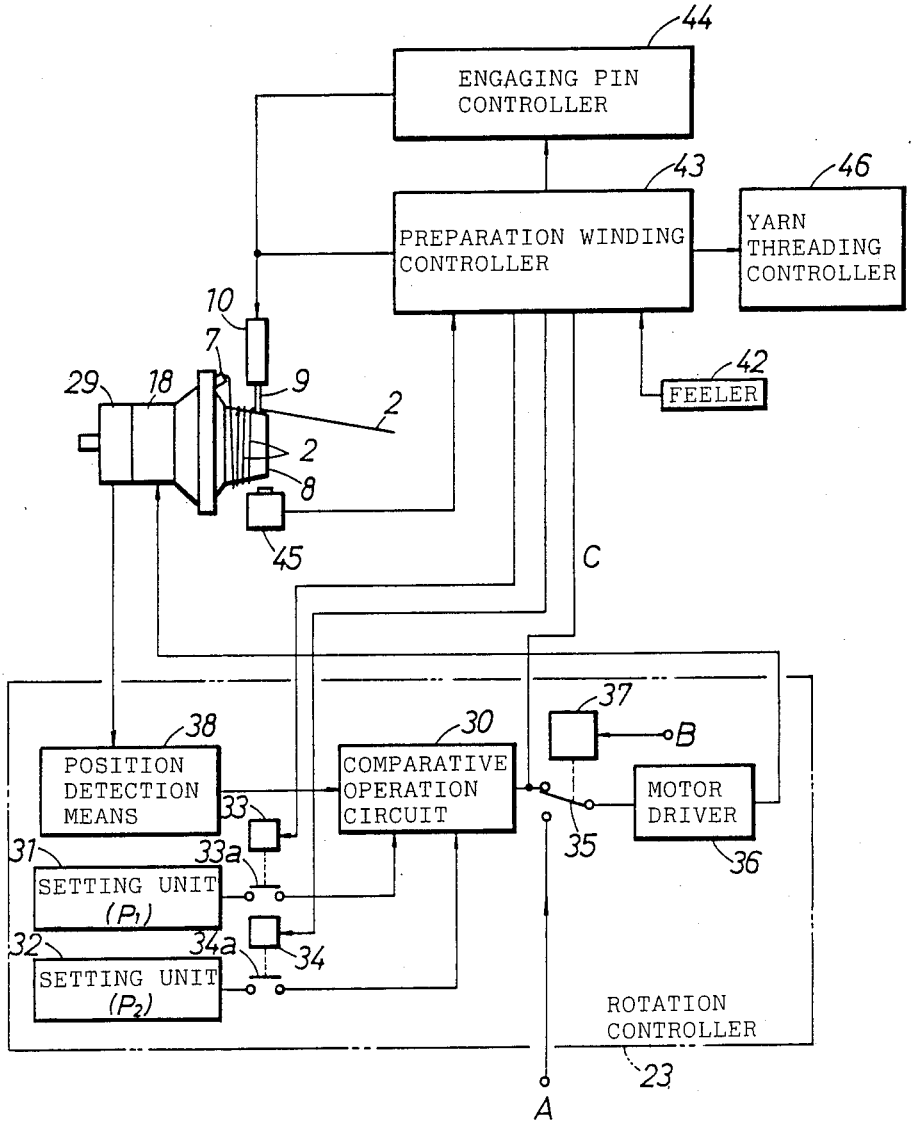
FIG. 4 is a block diagram of a rotation controller.

FIG. 4 shows a relation between the rotation controller 23 and the preparation winding controller 43, etc. The rotation controller 23 causes the rotatable yarn guide 7 to stop at a first stoppage position P1, namely at a position corresponding to the yarn holder 21, thereafter causes the rotatable yarn guide 7 to rotate through a required angular displacement to thereby stop the rotatable yarn guide 7 at a second stoppage position P2. An encoder 29 connected with the feeder motor 18 is provided for detecting the angular position of guide 7. The encoder 29 is connected with an input terminal of a comparative operation circuit 30 via a position detection means 38.

The comparative operation circuit 30 has other input terminals connected with setting units 31, 32 for setting a rotatable angle of the first stoppage position P1 and the second stoppage position P2 via contact points **33*a*, 34*a* of relays 33, 34, and an output terminal connected with a motor driver 36 via change-over switch 35. To the motor driver 36 for driving the feeder motor 18 is applied a winding length control signal A and the feeder motor 18 is actuated by switching the change-over switch 35 during a normal metering and storing operation. The change-over switch 35 is switched by a driver 37** when a set position stoppage signal B is applied thereto.

The preparation winding controller 43 is composed of an exclusive CPU or a part of a loom control unit, and controls an advance and retraction operation of the engaging pin 9 based on a sequence (stored program), instead of an engaging pin controller 44, during preparation winding operation of the weft yarn 2. The preparation winding controller 43 has input terminals connected with the feeler 42 and the release sensor 45, and has output terminals connected with an electromagnetic solenoid 10 of the engaging pin 9, the relays 33, 34, one of the contacting points of the changeover switch 35, the yarn threading controller 46, and the engaging pin controller 44. The engaging pin controller 44 controls the metering and storing operation of the weft yarn 2, and effects releasing of the yarn 2 synchronously with rotation of the loom, by appropriate control of the advance and the retraction of the engaging pin 9. The yarn threading controller 46 controls advance and retraction operations of the air cylinder 25, the operation unit 28 of the cutter 27, and the cutter 41.

The weft storage device 1 and the automatic resetting device 20 are respectively operated as follows. The weft yarn 2 is drawn out from the yarn supplier 3 and is wound around the outer circumference of the stationary drum 8 while the weft yarn 2 is held by the engaging pin 9 during a normal weaving process. When the engaging pin 9 is engages the outer circumference surface of the storage drum 8, by being driven by the electromagnetic solenoid 10, the rotatable yarn guide 7 winds the weft yarn 2 around the outer circumference surface of the storage drum a required number of turns. At this time, the weft yarn 2 is engaged by the engaging pin 9, and has a portion extending to the main nozzle 11 for weft insertion.

When the engaging pin 9 is retracted by actuation of the electromagnetic solenoid 10 at the weft yarn insertion time, the weft yarn 2 wound around the storage drum 8 is released by the engaging pin 9 so that the main nozzle 11 for weft insertion causes the weft yarn in a released state to be inserted into an opening 13 of the warp yarns 12 with a fluid for weft insertion. The winding length control signal A is applied to the motor driver 36 to cause the feeder motor 18 to rotate through a required number of turns to keep the winding length of the weft yarn 2 around the outer circumference surface of the storage drum 8 at a predetermined number of turns at all times. The storage operation and the weft insertion operation are at all times effected synchronously with the rotation of the loom by actuation of the engaging pin controller 44.

During the metering operation and the weft insertion operation the automatic resetting device operates as follows. When the weft yarn is broken between the yarn supplier 3 and the main nozzle 11, for example, from the rotatable yarn guide 7 to the main nozzle 11 and where no part of the weft yarn remains on the storage drum 8. The feelers 14, 15 or the feeler 19 for the main nozzle detect the state of breakage and absence of yarn on the drum to generate a weft yarn stoppage signal and deliver it to the known weft yarn stoppage controller. The weft yarn stoppage controller stops the operation of the loom and generates a set position stoppage signal B which is delivered to the driver 37. When the weft yarn is broken between the supplier 3 and the rotatable yarn guide 7, the supply feeler 5 detected the same state and the operation thereafter is effected in the same manner. At this time, a new weft yarn 2 is delivered from the supplier 3 to the rotatable yarn guide 7 in the manner disclosed in Japanese Laid-Open Patent Publication No. 59-165338 (U.S. Pat. No. 4,658,866 and European Patent Laid-Open Publication No. 0171057). The driver 37 permits the comparative operation circuit 30 to connect with the motor driver 36 by switching the change-over switch 35. The rotation position of the feeder motor 18 is detected by the encoder 29 and is converted to a prescribed pulse signal by the position detection means 38. The converted pulse signal is applied to the comparative operation circuit 30.

During this operation a starting instruction from the weft controller is applied to the preparation winding controller 43 to thereby stop the engaging pin controller 44. Since the contacting point **33*a* is set to an on-state by actuation of the relay 33, the comparative operation circuit 30 responds to a coincidence of a pulse number from the position detection means 38 with a pulse number corresponding to a first stoppage position P1 from the setting unit 31 by stopping the rotation of the feeder motor 18 by the motor driver 36. At this stoppage time, the rotatable yarn guide 7 is in a first stoppage position P1 as shown in FIG. 5 (1) angularly aligned with the open end of the yarn holder 21**.

The yarn holder 21 at this state draws the weft yarn 2 therein with the air stream generated by the suction air generator source 24 to thereby hold the end of the weft yarn 2.

Thereafter, the relay 33 is turned off by an actuation of the preparation winding controller 43, and the contacting point **34*a* is turned on to thereby allow the motor driver 36 to rotate again the feeder motor 18. During this operation, the comparative operation circuit 30 detects the second stoppage position P2 and stops the rotatable yarn guide 7 at the rotatable angle of the second stoppage position P2. Thus, the weft yarn 2 is linearly stretched between the rotatable yarn guide 7 and the yarn holder 21 so as to cross the path of movement of the yarn guide member 22**.

Figure 5:
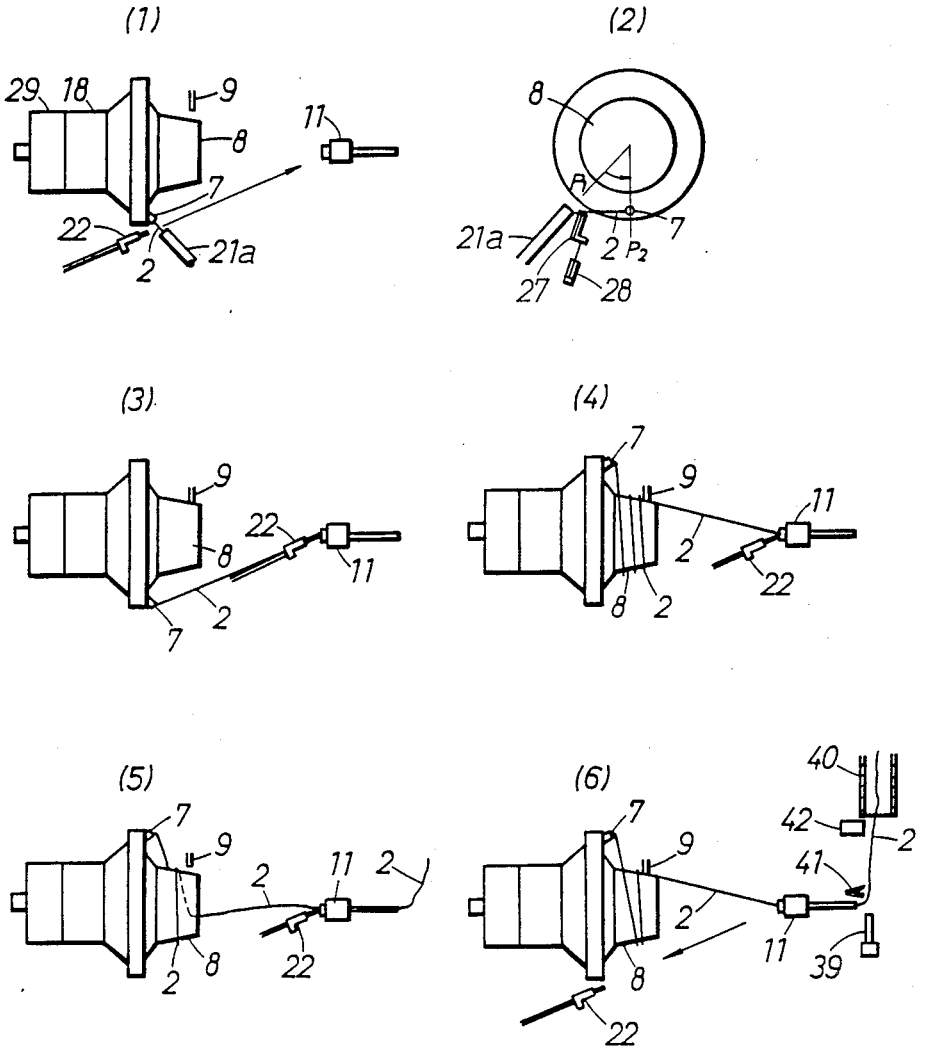
FIG. 5 (1) to (6) are views showing the manner in which an automatic resetting apparatus operates.
Figure 6:
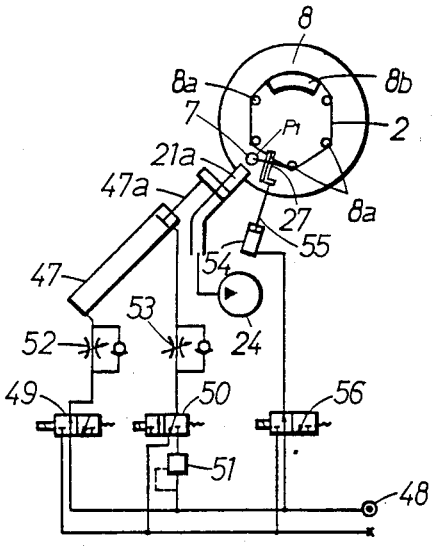
FIG. 6 is a front elevational view of an alternative embodiment of the apparatus of FIG. 2.
Figure 7:
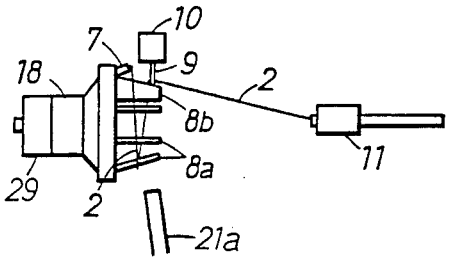
FIG. 7 is a side elevational view of the apparatus of FIG. 6.

The air cylinder 25 thereafter receives from outside a driving fluid based on an instruction from the yarn threading controller 46 to move the piston rod 26 from the retracted position to the advanced position as shown in FIG. 5 (3) to thereby move the weft yarn 2 clamped and held by the yarn guide member 22 from between the rotatable yarn guide 7 and the suction pipe **21*a* to the inlet end of the main nozzle 11. The holding operation is effected by the instruction from the yarn thread controller 46. At this time, the cutter 27 cuts off the weft yarn 2 between the suction pipe 21*a* and the yarn guide 22 to release the end of the weft yarn 2 from the suction pipe 21*a*. The cutter 27 may be omitted when the end of the weft yarn is not held by the yarn holder 21 but is held loosely by a loose clamp. In this manner, the weft yarn 2 from the rotatable yarn guide 7 is guided to the inlet end of the main nozzle 11 by the yarn guide member 22. The tip of the weft yarn 2 is at this state located at the inlet end of the main nozzle 11 without being completely threaded into the main nozzle 11. The weft yarn 2 is then ready to be threaded into the main nozzle 11 with the air stream for weft insertion. The preparation winding controller 43 issues an engaging instruction to the electromagnetic solenoid 10 of the engaging pin 9 to advance the engaging pin 9 to the outer circumference surface of the storage drum 8, and generates the preparation winding signal C which is applied to the motor driver 36. At this time, the rotatable yarn guide 7 is rotated in a prescribed number of rotations as shown FIG. 5 (4) to preparatorily wind a new weft yarn around the outer circumference surface of the storage drum 8. Upon completion of winding the new weft yarn 2 the prescribed number of turns, the rotatable yarn guide 7 is automatically stopped by a loss of the preparation winding signal C. The preparation winding controller 43, upon completion of the winding, releases the yarn guide member 22 to allow the tip end of the weft yarn 2 to be in a free state and issues a release instruction to the electromagnetic solenoid 10 so that the engaging pin 9 is retracted away from the outer circumference surface of the storage drum 8 to release the engagement of the weft yarn in a winding state. At this moment, the weft yarn 2 in the winding state is released from the outer circumference surface of the storage drum 8 and is threaded into the main nozzle 11 with the air stream for weft threading, and the tip end of the weft yarn 2 is in a free state as shown in FIG. 5 (5**).

During this state, the release sensor 45 counts a number of turns of the weft yarn 2 to be wound around the outer circumference surface of the storage drum 8, and the counted number is delivered to the preparation winding controller 43. The preparation winding controller 43 causes the engaging pin 9 to advance to the outer circumference surface of the storage drum 8 when the prescribed number of turns of the weft yarn 2 is received to thereby hold the weft yarn 2 against the outer circumference surface of the storage drum 8 as shown in FIG. 5 (6). The yarn guide member 22 retracts to an original waiting position upon receipt of a retraction instruction.

The end of the weft yarn 2 is bent by an air stream from the blowing nozzle 39 and inserted into the suction pipe 40, which is confirmed by the feeler 42. Upon confirmation of this state, the preparation winding controller 43 issues the operation instruction to the yarn threading controller 46 to use the cutter 41 to cut off the weft yarn 2 at the tip end of the main nozzle 11.

At this time, the set position stoppage signal B is terminated and the change-over switch 35 allows the winding length control signal A to be applied to the motor driver 36 so that the motor driver 36 drives the feeder motor 18 to rotate the rotatable yarn guide 7 by a prescribed amount of rotation for thereby allowing the weft yarn 2 to be wound around the outer circumference surface of the storage drum 8 by the required number of turns.

In this manner, the automatic resetting device 20 stores the weft yarn required for insertion around the storage drum 8 and allows the tip end of the weft yarn 2 threaded into the main nozzle 11 to be prepared for an automatic restarting of the loom.

According to the first embodiment, the preparation controller 43 controls the engaging pin 9 during preliminary winding operation and controls the rotation controller 23 (through generation of preparation winding signal C). The control of pin 9 and controller 23 at other times may be effected by a main control unit of the loom. The preparation controller 43 is effected by utilizing functions of a control operation, memory of a CPU, etc.

These functions are defined by a CPU of the main control unit of the loom or a host computer for centralizing control of a group of looms.

Although the yarn supporter 21 is composed of the suction pipe 21*a* according to the first embodiment, the yarn supporter 21 may alternatively be composed of a clamp means to frictionally clamp the end of the weft yarn. The yarn guide member 22 may be composed of an air fluid not limiting to the means to hold frictionally.

Second Embodiment (FIGS. 6 to 9):

Although the first embodiment relates to a method of and apparatus for automatically resetting a weft storage device when no part of the weft yarn 2 remains on the storage drum 8, the second embodiment relates to a method and apparatus for automatically resetting a weft storage device when a preparation winding operation is started only after removing apart the weft yarn 2 from remaining on the storage drum 8. To achieve this object, the suction pipe 21*a* is provided in the manner that the suction pipe 21*a* is movable between the waiting position and the suction position by the air cylinder 47. The air cylinder 47 is a double acting cylinder and is driven by a pressure source 48. The pressure source 48 is connected to cylinder 47 via change-over valves 49, 50 operable electromagnetically and via throttle valves 52, 53 having functions of check valves with a prescribed throttle opening for reverse flow. The cutter 27 is supported for movement from a retraction position to a cutting off position by a piston rod 55 of the cylinder 54 of the reciprocal driving means for cutting off the weft yarn 2 which remains on the storage drum 8. The cylinder 54 is a single acting type capable of springback, and is connected with the pressure source 48 by the electromagnetic change-over valve 56.

The storage drum according to the second embodiment comprises plurality of a drum pins 8*a* and a drum body 8*b*. When an defective weft threading is detected by the weft feelers 14, 15, the loom is automatically stopped. At this time, the rotatable yarn guide 7 is also stopped. The stoppage position at that time is set to the first stoppage position P1 as in the first embodiment. During this stoppage period, the feeler 19 for the main nozzle detects the breakage state of the weft yarn between the storage drum 8 and the main nozzle 11. When a quantity of the weft yarn 2 remains on the storage drum 8, the same state is confirmed by the release sensor 45. Thereafter, the change-over valves 49, 50 are activated by an actuation of the loom control unit. The air cylinder 47 causes the piston rod 47*a* to advance, and the piston rod 47*a* is controlled at an appropriate speed and causes the suction pipe 21*a* to move from the waiting position to the suction position, namely toward the outer circumference surface of the storage drum 8 until it is close to the outer portion of the weft yarn 2 kept wound on the drum pins 8*a* and it is stopped at this suction position. At this time, the open end of the suction pipe 21*a* is at the position where the weft yarn 2 in a wound state is subject to its suction forces.

Thereafter, the cylinder 54 moves the cutter 27 from the retraction position to the cutting off position by an actuation of the change-over valve 56 to thereby cut off the weft yarn 2 still wound around the outer circumference surface of the storage drum 8 by a mechanical shearing operation or thermal fusion operation.

Figure 8:
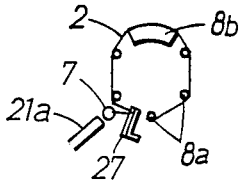
FIGS. 8 and 9 are respective front elevational views illustrative of the main parts of the apparatus of FIG. 6.
Figure 9:
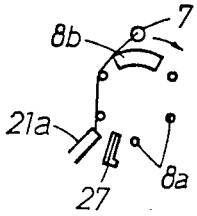

The segments of weft yarn 2 being cut off are successively drawn into the end of the suction pipe 21*a* and discharged at a prescribed position as shown in FIG. 8, since an air stream in the suction direction is generated in the interior of the suction pipe 21*a*. At this time, the yarn segments completely separated from the weft yarn 2 in the rotatable yarn guide 7 are drawn into the interior of the suction pipe 21*a* to be discharged at the prescribed position, while the weft yarn 2 drawn out from the supplier 3 to the rotatable yarn guide 7 has its end introduced into the suction pipe 21*a* and held there by the air stream as shown in FIG. 9.

Successively, the change-over valves 49, 50, and 56 are respectively turned off so that the suction pipe 21*a* is returned to the waiting position and the cutter 27 is returned to the retraction position.

The weft yarn 2 held by the suction pipe 21*a* is then guided to the inlet end of the main nozzle 11 by the yarn guide member 22.

The rotation controller 23 rotates the rotatable yarn guide 7 by the prescribed number of turns required for preparation winding to wind again the weft yarn 2 around the outer circumference surface of the storage drum 8.

Although the storage drum 8 is composed of the drum pins 8*a* to smoothly introduce the air stream into the open end of the suction pipe 21*a*, and to make the cutter 27 cross the weft yarn 2 wound thereon, the storage drum 8 may be structured in a complete circular cone. Such circular cone shaped storage drum 8 can operate in the same manner as mentioned above if an appropriate recess is formed in the drum 8 to allow the operations of the suction pipe 21*a* and the cutter 27.

Third Embodiment (FIGS. 10 to 19):

The third embodiment relates to a detailed driving means of the yarn guide member 22. When the air cylinder 25 is employed as a driving means of the yarn guide member 22, the stroke of the air cylinder 25 is substantially equal to the distance from the tip end of the rotatable yarn guide 7 to the main nozzle 11. As a result, there are problems in that the apparatus is large in size and the incorporation of it into the loom is difficult, and further, a guide speed is limited in its high speed since the speed of the yarn guide member 22 is the same speed as that of the piston rod 26.

It is therefore an object of the third embodiment to miniaturize the apparatus by reducing the stroke of the driving means, and the same time to speed up the threading operation by increasing the guide speed of the weft yarn.

According to the third embodiment, the yarn guide member 22 is retractably provided between the rotatable yarn guide 7 and the main nozzle 11 for weft insertion, and further a double speed mechanism is provided between the yarn guide member 22 and the driving source.

The double speed mechanism comprises a winding transmission mechanism composed of a pair of rollers and a winding body entrained around the rollers, or a gear mechanism composed of two racks and pinions engaged with the two racks. A linear operation of the driving source is set to be doubled in stroke and speed, and the yarn guide member 22 is moved via a guide supporter. Therefore, the entire length of the air cylinder as the driving means is shortened and the moving speed of the yarn guide member 22 is increased.

Figure 10:
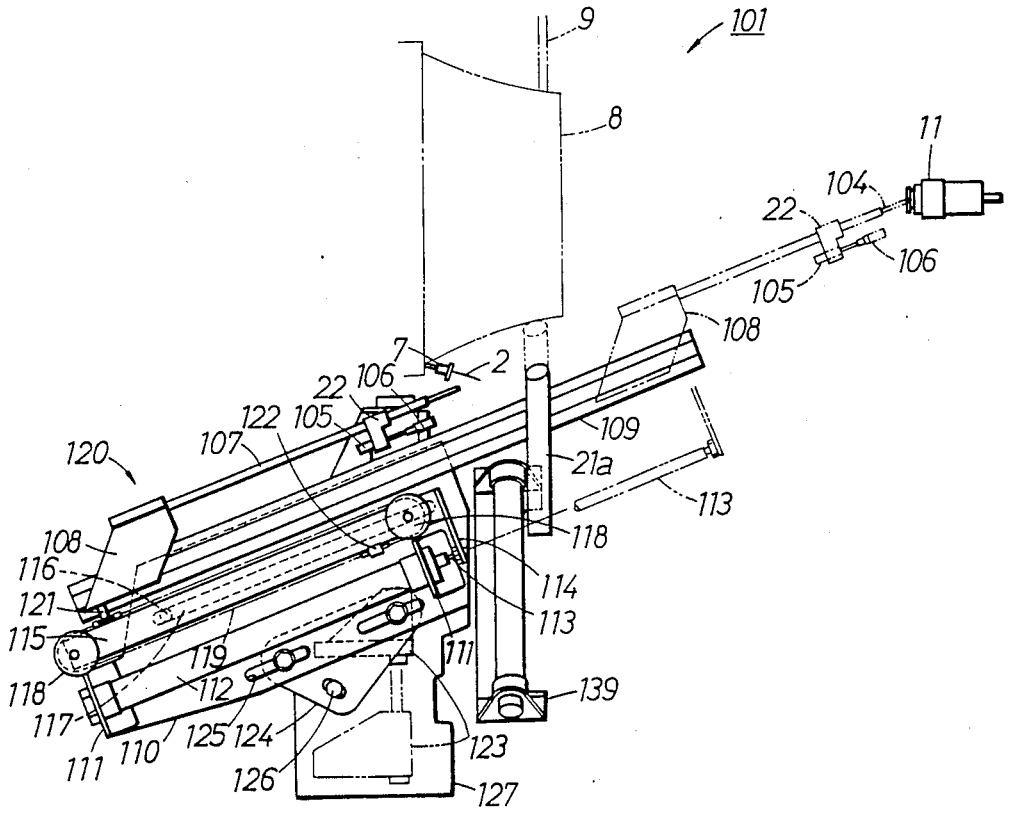
FIG. 10 is an enlarged side view of a weft storage device having a double speed mechanism.
Figure 11:
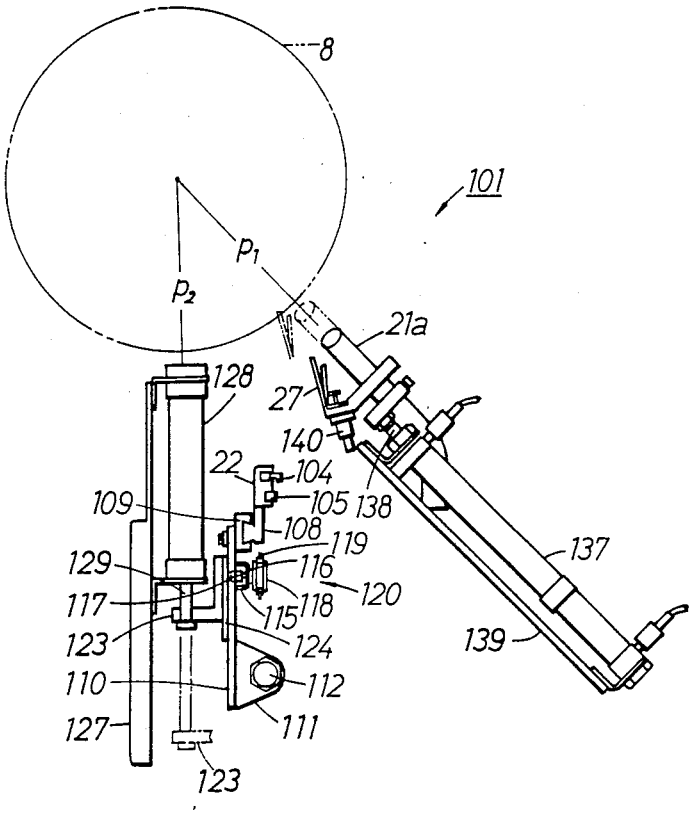
FIG. 11 is a rear view of the apparatus of FIG. 10.
Figure 12:
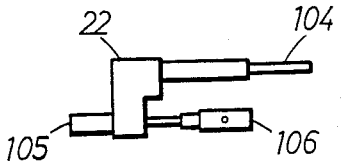
FIG. 12 is a plan view of a yarn supporter.
Figure 13:
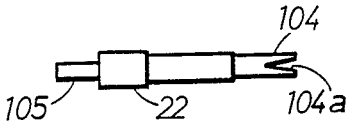
FIG. 13 is a side elevational view of the supporter of FIG. 12.

FIGS. 10 and 11 show a structure of the guide unit 101. The yarn guide member 22 of the guide unit 101 is provided with a holder 104 having a V-shaped groove 104*a* (FIG. 13) and a clamper 106 driven by an air cylinder 105. The yarn guide member 22 is fixedly mounted on a slider 108 by a support rod 107. The slider 108 is supported in a dovetail of the guide 109 provided parallel with a moving direction of the yarn guide member 22 and is slidably supported thereby. The guide 109 is provided over a base 110. The slider 108 and the guide 109 constructed the guide supporter.

The base 110 supports an air cylinder 112 as a driving source causing a linear reciprocal movement, such support being effected by a pair of brackets 111. The air cylinder 112 is provided parallel with the guide 109 and is connected with a tip end of a movable body 115 by a connecting plate 114 at the tip end of a piston rod 113. The movable body 115 is parallel with the guide 109 and slidably movable by a guide roller 116 along the guiding long slit 117 defined by the base 110. The movable body 115 rotatably supports a pair of rotatable rollers 118 at both ends thereof.

The pair of rotatable rollers 118 and a winding body 119 entrained around the rotatable rollers 118 construct the double speed mechanism. That is, the winding body 119 is fixed to the slider 108 close to one of the rotatable rollers 118 by a connector 121 and fixed to the base 110 close to another rotatable roller by a fixing member 122.

The base 110 is mounted in a state to be adjustable in its position by a long slit 117 and a fixing bolt 126 with respect to a fixing plate 124 of a movable base 123. The movable base 123 is slidably vertically supported with respect to a frame 127 and connected with a piston rod 129 of a waiting air cylinder 128 fixed to the frame 127.

The guide unit 101 is fixed to a frame of the loom under the drum 8 by the frame 127. The movable base 123 is slidably movable in the radial direction of the storage drum 8. The yarn guide member 22 is slidably provided for movement from the tip end of the yarn guide 7 to the main nozzle 11 for weft insertion.

The suction pipe 21*a* and the cutter 27 are respectively supported by a piston rod 138 of an air cylinder 137, and movable in the radial direction of the storage drum 8. The air cylinder 137 is fixed to the frame of the loom by a support plate 139, etc. The cutter 27 is drivable by the operation unit 28 of the cutter, for example, the air cylinder 140.

An operation of the guide unit 101 is described. During a normal threading operation, the air cylinder 128 lowers the movable base 128 to separate the storage drum 8 from the base 110 to thereby permit the storage drum 8 to be in a waiting state. The air cylinder 112 causes the yarn guide member 22 to be in a retracted position by retracting the piston rod 113.

Figure 14:
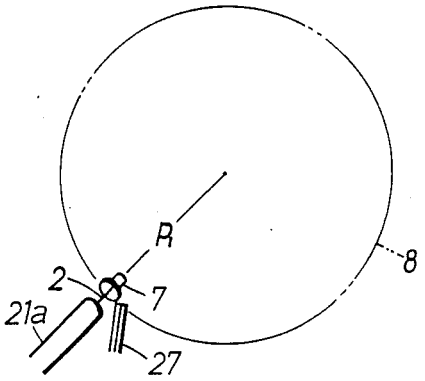
FIGS. 14 and 15 are respective views illustrative of operation sequences.

When the weft yarn 2 is broken, the rotatable yarn guide 7 is stopped at the first stoppage position P1 and is ready for a threading operation as shown in FIG. 14.

The air cylinder 137 allows the piston rod 138 to advance the suction pipe 21*a* and the cutter 27 to the position close to the first stoppage position P1 as shown in FIG. 14. The suction pipe 21*a* attracts the weft yarn 2 by drawing the end of the weft yarn 2 with the air stream generated in the suction direction.

When a portion of the weft yarn 2 remains wound around the outer circumference surface of the storage drum 8, it weft yarn 2 is cut off by the cutter retractably movable by another device, for example, the air cylinder. The cut off weft yarn 2 and the end of the weft yarn 2 in the rotatable yarn guide are respectively drawn into the suction pipe 21*a*.

Figure 15:
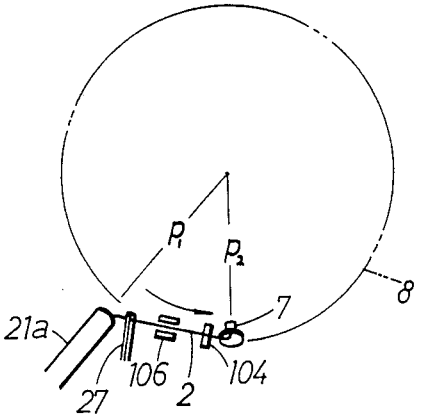

Thereafter, the rotatable yarn guide 7 is rotated from the first stoppage position P1 to the second stoppage position P2. As a result, the weft yarn 2 held by the rotatable yarn guide 7 and the suction pipe 21*a* is linearly stretched between them as shown in FIG. 15 to be in a state crossing the moving path of the holder 104 of the yarn guide member 22. The waiting air cylinder 128 causes the base 110 to lift by drawing in the piston rod 129 for thereby causing the yarn guide member 22 to move into the prescribed operation position. Thereafter, the air cylinder 112 as a driving source makes the movable body 115 advance using the piston rod 113 to thereby advance the pair of rotatable rollers 118.

Figure 16:
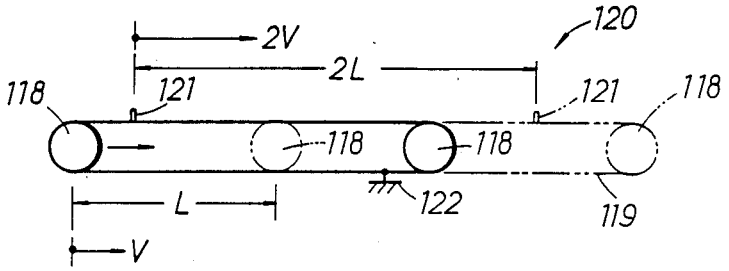
FIG. 16 is a view illustrating a principle of the double speed mechanism of FIG. 10.
Figure 17:
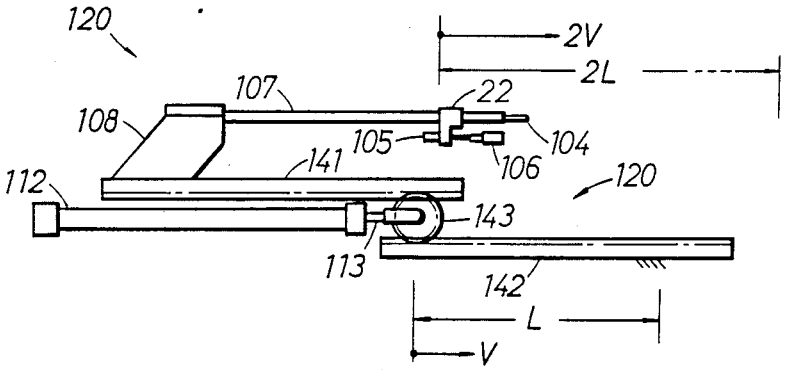
FIG. 17 is side elevational view of a double speed mechanism according to another embodiment.

With this advance movement, the guide roller 116 is advanced and rotated since one part of the winding body 119 is fixed to the base 110 by the fixing member 122. As a result, the slider 108 is advanced, while guided by the guide 109, at twice the stroke L of the driving means and twice its speed V, as shown in FIG. 16.

At the first stage of advance movement, the holder 104 clamps the weft yarn 2 in the V-shaped groove 104*a*, at a location between the rotatable yarn guide 7 and the suction pipe 21*a*, and the clamper 106 holds the weft yarn 2 in a clamped state as it is moved by the air cylinder 105. The cutter 27 cuts off the weft yarn 2 between the clamper 106 and the suction pipe 21. The cutting off operation is not necessary and can be omitted if the length of drawing of the weft yarn 2 is less in the suction pipe 21*a* and the weft yarn 2 is ready for drawing easily. Thus, the yarn guide member 22 is advanced to the main nozzle 11 and guides the weft yarn 2 to the inlet end of the main nozzle 11 and is stopped there while holding the end of the weft yarn 2 and drawing the weft yarn 2 from the rotatable yarn guide 7. Inasmuch as a speed of the yarn guide member 22 in these operations is two times the advance speed of the piston rod 113, the operation time of the yarn guide 22 is reduced in half compared with the other embodiments.

Since the clamper 106 releases the end of the weft yarn 2 when the yarn guide member 22 is moved to the limit of the advance, the weft yarn 2 in a free state is drawn into the interior of the main nozzle 11 with the air stream for weft insertion. The threading operation of the weft yarn 2 is thus automatically effected. Following these operations, the yarn guide member 22 is moved to the original limit of retraction and the base 110 is lowered to the waiting position so that the yarn guide member 22 and the base 110 are respectively ready for next operation. The double speed mechanism 120 is composed of a winding transmission mechanism according to the third embodiment. The double speed mechanism may alternatively be composed of a rack 141 slidably fixed to the slider 108, a rack 142 fixed to the base 110, and a pinion 143 rotatably supported by a tip end of the piston rod of the air cylinder 112 actuatable as driving source and located between racks 141, 142. The rack 141 supports the yarn guide member 22 by the slider 108 and the support rod 107.

When the pinion 143 is advanced with the piston rod 113 of the air cylinder 112, the pinion 143 is rotated due to engagement with the rack 142 at the fixed side so that the movable rack 141 is moved in an advance direction with the speed twice as fast as the piston rod 113 by pinion 143.

The stroke L of the yarn guide member 22 becomes two times that of the piston rod 113 of the air cylinder 112.

Figure 18:
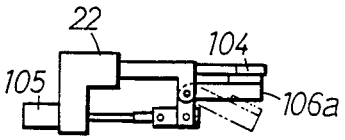
FIG. 18 is a plan view of a yarn guide member according to another embodiment.
Figure 19:
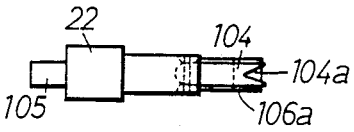
FIG. 19 is a side elevational view of the member of FIG. 18.

The embodiment as shown in FIGS. 18 and 19 shows the holder 104 of the yarn guide member 22 supporting the clamper 106.

The third embodiment employs the air cylinder capable of linearly moving as a driving source. However, the driving source may be composed of another mechanism to convert a rotatable movement finally to the reciprocal movement, for example by combining a motor and a feeder screw unit since the driving source is good enough to deliver finally the reciprocal movement.

According to the present invention, the following advantages are achieved.

Firstly, the driving means may be miniaturized to thereby reduce the driving energy in proporation thereto since the stroke of the driving means can be reduced to half that of the yarn guide member 22.

The threading process time is shortened to increase the availability of the loom since the movement speed of the yarn guide member 22 is set to be twice as fast as the output speed of the driving means. Further, a quality of the fabric is increased, and particularly a generation of the stopping mark caused by a stretch of the warp yarn when the loom is restarted is prevented.

What is claimed is:

1. A method of automatically resetting a weft storage device having a rotatable yarn guide which can wind a weft yarn from a supplier around an outer circumference of a storage drum and having means supporting an engaging pin for movement between two positions in which said pin engages and is spaced from a circumference surface of said storage drum and in which said pin respectively prevents and permits withdrawal of yarn from said drum, said method comprising the steps of: detecting a condition in which the weft yarn has broken between said supplier and a main nozzle for weft insertion; thereafter stopping said rotatable yarn guide at a prescribed first position; holding an end of the weft yarn from said rotatable yarn guide with a yarn holder and rotating said rotatable yarn guide to and stopping it in a second position in which an end portion of the weft yarn extends from said yarn holder to said rotatable yarn guide across a path of movement of a movable yarn guide member; moving said yarn guide member so that said yarn guide member engages the weft yarn and moves the end portion of the weft yarn to a location adjacent said main nozzle; moving said engaging pin to said position engaging said circumference surface of said storage drum; and causing said rotatable yarn guide to wind onto said storage drum a prescribed number of turns of the weft yarn while said engaging pin is engaging said circumference surface of said storage drum.

2. A method according to claim 1, including the steps of releasing the end portion of the weft yarn from said yarn guide member upon completion of said step of causing said rotatable yarn guide to wind around the outer circumference of said storage drum a prescribed number of turns, thereafter moving said engaging pin to said position spaced from said surface of said drum and threading the end portion of the weft yarn into said main nozzle while withdrawing from said storage drum a predetermined number of turns of the weft yarn.

3. A method according to claim 1, including after said detecting step and prior to said step of stopping said rotatable yarn guide in said first position the steps of cutting off any portion of the weft yarn remaining on said storage drum, and drawing any portion of the weft yarn cut off said storage drum into an interior of a suction pipe.

4. An apparatus for automatically resetting a weft storage device, comprising: a storage drum having an outer circumference surface, a yarn guide rotatable around said storage drum for winding a weft yarn supplied from a supplier around the circumference surface of said storage drum, means supporting an engaging pin for movement toward any away from the circumference surface of said storage drum between positions engaging and spaced from the weft yarn to respectively prevent and permit withdrawal of the weft yarn from said storage drum, detection means for detecting a condition in which the weft yarn has broken between said supplier and a main nozzle for weft insertion, rotation controller means responsive to said detection means for stopping said rotatable yarn guide at a first stoppage position when the weft yarn is broken between said supplier and said main nozzle and for subsequently moving said rotatable yarn guide to and stopping it in a second stoppage position, yarn holder means for releasably holding an end of the weft yarn from said rotatable yarn guide as said rotatable yarn guide is rotated from said first stoppage position to said second stoppage position, yarn guide means for engaging a portion of the weft yarn stretched between said yarn holder means and said rotatable yarn guide when said yarn guide is positioned at said second stoppage position and for moving the portion of the weft yarn to said main nozzle and then releasing the weft yarn, and preparation winding controller means for causing said engaging pin to move to said position engaging the weft yarn on said storage drum after said yarn guide means has moved the portion of the weft yarn to the main nozzle, and for thereafter issuing a signal to said rotation controller, said rotation controller responding to said signal by causing said rotatable yarn guide to wind around said storage drum a prescribed number of turns of the weft yarn.

5. An apparatus according to claim 4, wherein said preparation winding controller means causes said engaging pin to move to said position spaced from the weft yarn on said storage drum after said prescribed number of turns of the weft yarn have been wound on said storage drum, and to thereafter move to said position engaging the weft yarn on said storage drum when said prescribed number of turns of the weft yarn have been subsequently withdrawn from said drum.

6. An apparatus for automatically resetting a weft storage device according to claim 4, wherein said yarn guide means includes a base, a guide supporter having a yarn guide part thereon and supported for reciprocal movement relative to said base between positions in which said yarn guide part is respectively adjacent said drum and adjacent said main nozzle, a driving source supported on said base and having an output part supported for reciprocal linear movement relative to said base, and double speed means responsive to the reciprocal movement of said output part of said driving source for effecting synchronous reciprocal movement of said guide supporter at a speed which is twice that of said output part.

7. An apparatus according to claim 6, wherein said double speed means includes a movable body which is moved reciprocally by said output part of said driving source, a pair of rotatable rollers rotatably supported on said body, and an endless winding body which is entrained around said rotatable rollers and which has two spaced portions respectively fixed to said guide supporter and said base.

8. An apparatus according to claim 6, wherein said double speed means includes a first rack fixed to said guide supporter, a second rack fixed to said base in a position parallel with said first rack, and a pinion provided between and engaged with each of said racks, said pinion being rotatably supported on said output part of said driving source and said output part of said driving source moving in directions parallel to said racks.

9. A method of automatically resetting a weft storage device which includes a storage drum, a yarn guide supported for rotation around said drum for winding thereon a weft yarn from a yarn supplier, selectively actuable yarn holding means in the region of said drum for releasably holding an end of the weft yarn when actuated, a main nozzle for withdrawing from said drum and inserting into a loom shed the weft yarn, a guide part supported for movement between positions respectively adjacent said drum and adjacent an inlet of said main nozzle, and yarn withdrawal control means for respectively preventing and permitting withdrawal of the weft yarn from said drum when respectively actuated and deactuated, comprising the steps of: monitoring the weft yarn and detecting a condition in which the weft yarn breaks between said yarn guide and said main nozzle; thereafter moving said yarn guide to a first angular position adjacent said holding means; actuating said holding means so that said holding means releasably holds an end of the weft yarn from said yarn guide; thereafter moving said yarn guide to a second angular position spaced from said first position so that a portion of the weft yarn extends between said holding means and said yarn guide and across a path of movement of said guide part; and thereafter moving said guide part from said position adjacent said drum to said position adjacent said main nozzle so that the portion of the weft yarn is moved to a location adjacent said inlet of said main nozzle.

10. A method according to claim 9, including after said detecting step and prior to said step of moving said yarn guide to said first angular position the steps of cutting off said drum any portion of the weft yarn remaining thereon while simultaneously drawing any portion of the weft yarn cut off said drum into a suction arrangement for disposal.

11. A method according to claim 9, including after said step of moving said guide part the steps of: actuating said withdrawal control means; thereafter causing said rotatable yarn guide to wind a predetermined number of turns of the weft yarn onto said storage drum; thereafter deactuating said withdrawal control means, deactuating said holding means, actuating said main nozzle to cause the end of the weft yarn to be threaded through said main nozzle, detecting the number of turns of the weft yarn withdrawn from said storage drum, and actuating said withdrawal control means when a predetermined number of turns have been withdrawn from said drum; and thereafter causing said rotatable yarn guide to wind onto said drum a predetermined number of turns of the weft yarn.

12. A method according to claim 11, including after said step of actuating said main nozzle to thread the end of the weft yarn therethrough the step of cutting off a portion of the end of the weft yarn which extends beyond an outlet of said main nozzle.

13. A weft storage apparatus adapted to be automatically reset, comprising: a storage drum, a yarn guide supported for rotation around said storage drum to wind thereon a weft yarn from a yarn supplier, selectively actuable yarn holding means in the region of said drum for releasably holding an end of the weft yarn when actuated, a main nozzle which has an inlet and an outlet and can withdraw from said drum and insert into a loom shed the weft yarn, a guide part supported for movement between positions respectively adjacent said drum and adjacent said inlet of said main nozzle, yarn withdrawal control means for respectively preventing and permitting withdrawal of the weft yarn from said drum when respectively actuated and deactuated, and controller means for controlling said yarn guide, said holding means, said main nozzle, said guide part and said withdrawal control means, said controller means including: means for monitoring the weft yarn and detecting a condition in which the weft yarn breaks between said yarn guide and said main nozzle; means responsive to detection of said condition for moving said yarn guide to a first angular position adjacent said holding means; means for causing said holding means to be actuated when said yarn guide is in said first angular position so that said holding means releasably holds an end of the weft yarn from said yarn guide; means for moving said yarn guide while said holding means is actuated from said first angular position to a second angular position which is spaced from said first angular position and in which a portion of the weft yarn extending between said holding means and said yarn guide extends across a path of movement of said guide part; and means for moving said guide part from said position adjacent said drum to said position adjacent said main nozzle while said holding means is actuated and said yarn guide is in said second angular position so that said guide part engages and moves the portion of the weft yarn to a location adjacent said inlet of said main nozzle.

14. An apparatus according to claim 13, wherein said controller means includes means responsive to said guide part reaching said position adjacent said main nozzle for actuating said withdrawal control means and for causing said yarn guide to wind onto said drum a first predetermined number of turns of the weft yarn, means for thereafter deactuating said withdrawal control means and said holding means and actuating said main nozzle so that the end of the weft yarn is threaded through said main nozzle, means responsive to withdrawal of a predetermined number of turns of the weft yarn from said drum during threading of said nozzle for actuating said withdrawal control means, and means for thereafter causing said yarn guide to wind onto said drum a second predetermined number of turns of the weft yarn.

15. An apparatus according to claim 14, including cutter means disposed in the region of said outlet of said main nozzle for cutting off a portion of the weft yarn extending outwardly beyond said outlet of said main nozzle, and wherein said controller means includes means for actuating said cutter means after said actuation of said main nozzle which effects the threading of the end of the weft yarn through said main nozzle.

16. An apparatus according to claim 15, wherein said cutter means includes a blowing nozzle and suction means provided on opposite sides of said outlet of said main nozzle, said blowing nozzle being oriented to direct a jet of air transversely across said outlet of said main nozzle in a direction toward said suction means, and wherein said cutter means includes a cutter mechanism which is provided adjacent said outlet of said main nozzle and can cut a portion of the weft yarn extending from said outlet of said main nozzle of said suction means.

17. An apparatus according to claim 13, including selectively actuable cutter means for cutting off said drum any portion of the weft yarn remaining thereon and suction means for removing from said drum each piece of yarn cut off said drum by said cutter means, said controller means including means for actuating said cutter means and said suction means immediately following said detection of said condition in which the weft yarn breaks between said supplier and said nozzle.

18. An apparatus according to claim 17, wherein said suction means also serves as said yarn holding means.

19. An apparatus according to claim 13, wherein said means for effecting movement of said guide part includes a fluid-actuated cylinder having a reciprocally movable piston rod, said guide part being supported on said piston rod.

20. An apparatus according to claim 13, wherein said means for effecting movement of said guide part includes drive means having a drive part supported for reciprocal linear movement between first and second positions, and includes double speed means responsive to movement of said drive part from said first to said second position for causing said guide part to move linearly from said position adjacent said drum to said position adjacent said main nozzle at a speed which is twice the speed of movement of said drive part.

* * * * *

UNITED STATES PATENT AND TRADEMARK OFFICE

CERTIFICATE OF CORRECTION

PATENT NO. : 4 756 341

DATED : July 12, 1988

INVENTOR(S) : Tatsuo TAKEHANA

It is certified that error appears in the above-identified patent and that said Letters Patent is hereby corrected as shown below:

Column 12, Line 67; Change "toward any" to ---toward and---.

Column 16, Line 26; Change "said nozzle" to ---said main nozzle---.

Signed and Sealed this

Twenty-fourth Day of January, 1989

*Attest:*

DONALD J. QUIGG

*Attesting Officer*

*Commissioner of Patents and Trademarks*